US005298679A

United States Patent [19]

Wu et al.

[11] Patent Number: 5,298,679

[45] Date of Patent: Mar. 29, 1994

[54] CURRENT LEAD FOR CRYOSTAT USING COMPOSITE HIGH TEMPERATURE SUPERCONDUCTORS

[75] Inventors: Jiing-Liang Wu, Murrysville Borough; Jeffrey T. Dederer; Sharad K. Singh, both of Wilkins Township, Allegheny County, all of Pa.

[73] Assignee: Westinghouse Electric Corp., Pittsburgh, Pa.

[21] Appl. No.: 907,083

[22] Filed: Jul. 1, 1992

[51] Int. Cl.[5] ..... H01B 12/00

[52] U.S. Cl. ..... 174/15.4; 335/216; 505/885; 505/887

[58] Field of Search ..... 174/15.4, 15.5; 335/216; 505/704, 728, 885, 886, 887

[56] References Cited

U.S. PATENT DOCUMENTS

| | | | |
|---|---|---|---|
| 3,668,297 | 6/1972 | Buchhold et al. | 174/13 X |
| 3,715,452 | 2/1973 | Long | 335/216 X |
| 3,764,725 | 10/1973 | Kafka | 335/216 X |
| 4,384,168 | 5/1983 | Kenney | 174/126 S |
| 4,394,634 | 7/1983 | Vansant | 335/216 |
| 4,409,579 | 10/1983 | Clem et al. | 335/216 |
| 4,625,193 | 11/1986 | Purcell | 335/216 |
| 4,754,249 | 6/1988 | Yamamoto et al. | 335/216 |
| 4,895,831 | 1/1990 | Laskaris | 505/1 |

FOREIGN PATENT DOCUMENTS 58-98991 6/1983 Japan .

OTHER PUBLICATIONS

K. Sato, et al., High-$J_c$ Silver-Sheathed BL-Based Superconducting Wires, IEEE Transactions on Magnetics, vol. 27, No. 2, Mar., 1991, pp. 1231-1238.

Verga, Superconducting Magnetic Energy Storage and Other Large-Scale SDI Cryogenic Applications Programs, 24th Intersociety Energy Conversion Engineering Conference, IECEC-89, IEEE.

Heine et al., Processing of High-$T_c$ Superconductor Wires for Magnet Application, 1991 CEC/ICMC, Huntsville, Ala., Jun., 1991.

M. J. Neal, et al., DC Transport Measurements at 77K of High $J_c$ Cryostabilized Melt Processed YBCO Monofilament, IEEE Trans. Appl. Superconductivity, May 30, 1991.

*Primary Examiner*—Leo P. Picard
*Assistant Examiner*—Christopher Horgan
*Attorney, Agent, or Firm*—M. P. Lynch

[57] ABSTRACT

A vapor cooled current lead for a superconducting device located in a cryostat includes a normal conductor section extending from ambient conditions inward to an intermediate point, and a composite lead having a ceramic high temperature superconductor core with a metallic sheath extending between the normal conductor section and the superconducting device, preferably in a helical path to reduce heat leak by conduction. The metallic sheath is stripped away at spaced intervals, preferably adjacent the low temperature end of the composite lead, and the gaps are filled with a filler which provides mechanical strength for the core and reduces thermal conduction. A flow of cryogen vapor directed by a tubular housing maintains the high temperature superconducting material below its critical temperature, and cools the normal conductors.

15 Claims, 2 Drawing Sheets

29
27
25
23
15
5
58
21
55
31
53
9
55
17
57
55
57
55
7
19
13
47
37
43
49
45
11
33
41
65
35
39
3
51
1

CURRENT LEAD FOR CRYOSTAT USING COMPOSITE HIGH TEMPERATURE SUPERCONDUCTORS

BACKGROUND OF THE INVENTION

1. Field of the Invention

This invention relates to current leads for conducting current to or from superconducting equipment contained in a cryostat. More particularly, it relates to such power leads incorporating composite high temperature, superconductors.

2. Background Information

Current leads transmit power between cryogenic equipment located within a cryostat and a power supply or load located at higher temperatures, such as room temperature. Conventional current leads use metals such as copper for their entire length. These leads introduce heat leak to the cryostat as a result of heat conduction from the external conductors and the resistive heating in the lead itself. It is generally recognized that the current lead is an important if not a dominant source of heat leak into the liquid cryogens such as liquid helium. The heat leak causes the cryogen to boil off and, for an open cycle system sets a limit on the operating time of the cryogenic equipment. For a closed cycle system, a refrigeration and liquefier system is needed to recondense the cryogen vapor back to its liquid phase. Due to the temperature difference and limitations of liquefier efficiency, the refrigeration power required to recondense the cryogen vapor back to the liquid state generally is several hundred to over a thousand times the heat leak to the cryogen pool. A substantial reduction in refrigeration system capital cost as well as the operating cost can therefore be achieved by the reduction of heat leak to the cryogen pool.

The heat leak can be reduced by minimizing the resistive heating and/or heat conduction. The newly discovered ceramic superconductors, such as Y—Ba—Cu—O (YBCO), Bi—Sr—Ca—Cu—O (BSCCO) and Tl—Ba—Ca—Cu—O (TBCCO) systems, have critical temperatures higher than liquid $N_2$ temperature and can thus be used to eliminate the resistive heating in the low temperature part of the lead. These ceramic materials also have a thermal conductivity significantly lower than copper at temperatures near the liquid helium temperature. Both of these properties are ideally suited for minimizing the heat leak in the current lead.

The feasibility of this concept has been successfully demonstrated by a 2-kA current lead described in U.S. patent application Ser. No. 07/585,419 filed on Oct. 20, 1990. Heat leak reduction of up to 40% from optimized conventional leads has been achieved in testing.

The basic feature of the lead described in that application for achieving low heat leak is the employment of an array of ceramic superconductor bars which may, for example, be made from powders of YBCO and silver (15% vol.). These bars are connected to the cryogenic device via a lower copper plate and are designed to operate from 4.2K to liquid nitrogen temperature. An array of copper conductors operates at a higher temperature range and interfaces to the room temperature power supply.

The superconductor bars are fabricated by pressing-/sintering/annealing method and, unless time consuming and expensive melt texturing technique is applied, generally have low critical current density of 100–300 A/cm$^2$ at zero external magnetic field and decreases rapidly with increasing external field. The limitation of critical current density produces two drawbacks for current lead application. First, the aforementioned superconductor current density is lower by a factor of five to ten as compared to the current density generally used in the copper portion of the lead. Thus, the superconductor portion requires substantially larger cross sectional area than the copper portion. This introduces complications in the design and fabrication of the lead and may exclude its use from the cases in which the space available for lead installation is not sufficient for the superconductor portion of the lead. Secondly, the low current density allows only limited margin in design flexibility in the considerations of conductor stability and heat leak optimization of the lead.

Composite superconductors of high critical current density have been developed such as silver sheathed composite high-$T_c$ superconductor wire made from powder-in-tube technique. Critical current densities as high as 31,000 A/cm$^2$ at 77K and 0.1T, and 11,000 A/cm at 77K and 1.0T have been demonstrated in silver sheathed Bi-based superconductor tape-shaped wires. In this kind of conductor, the silver sheath serves as a stabilizer as well as a mechanical structure to confine and strengthen the ceramic superconductor material. However, due to high thermal conductivity at low temperature, the silver sheath can introduce significant heat leak to the cryogen.

U.S. Pat. No. 4,895,831 discloses a cryogenic current lead having a ceramic superconductor wound on the sleeve of a cryo-cooler to increase the overall length of the lead and therefore reduce heat conduction through the lead.

There remains a need for a power lead for cryogenic equipment which has a high current density capacity yet contributes a minimum to heat leak into the cryostat.

SUMMARY OF THE INVENTION

This need and others are satisfied by the invention which is directed to a current lead for a superconducting device contained in a cryostat which includes a normal conducting section having normal conductors extending from ambient conditions outside the cryostat inward to an intermediate point. A superconducting section extends from the normal conductors to the superconducting device. This superconducting section includes a composite superconductor having a core of a ceramic high temperature superconducting material which is superconducting below an intermediate temperature which is between ambient temperature outside the cryostat and the operating temperature of the superconducting device within the cryostat. The composite superconductor includes a metallic sheath encasing and supporting the core of ceramic high temperature superconducting material. As the metallic sheath has a high thermal conductivity, it is stripped away at spaced apart intervals to form gaps. These gaps are filled with an adhesive which supports the core and has a thermal conductivity at least an order of magnitude below the thermal conductivity of the metallic sheath. The conductors of the superconducting section and normal conducting section of the current lead are cooled, preferably by cryogen vapor. The superconducting section is maintained by the cryogen vapor at a temperature below the intermediate temperature at which it is superconducting.

Preferably, the gaps in the metallic sheath which are filled by the adhesive with a low thermal conductivity are located adjacent the low temperature end of the superconductor.

In the preferred form of the invention, the core of the composite superconductor is made of a yttrium bismuth, or thallium compound and the metallic sheath is silver. Also, preferably, the adhesive with low thermal conductivity is an epoxy.

Preferably, the composite superconducting leads and the normal conductors are cooled by cryogen vapor.

The current lead of the invention, with gaps in the metallic sheath of the composite high temperature superconductor filled with an adhesive with low thermal conductivity, significantly reduces heat leak into the cryostat and therefore reduces the amount of vapor required in an open vapor cooling system and reduces the capacity required for a closed system. At the same time, it provides a power lead with high current carrying capacity which simplifies the physical design of the lead.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
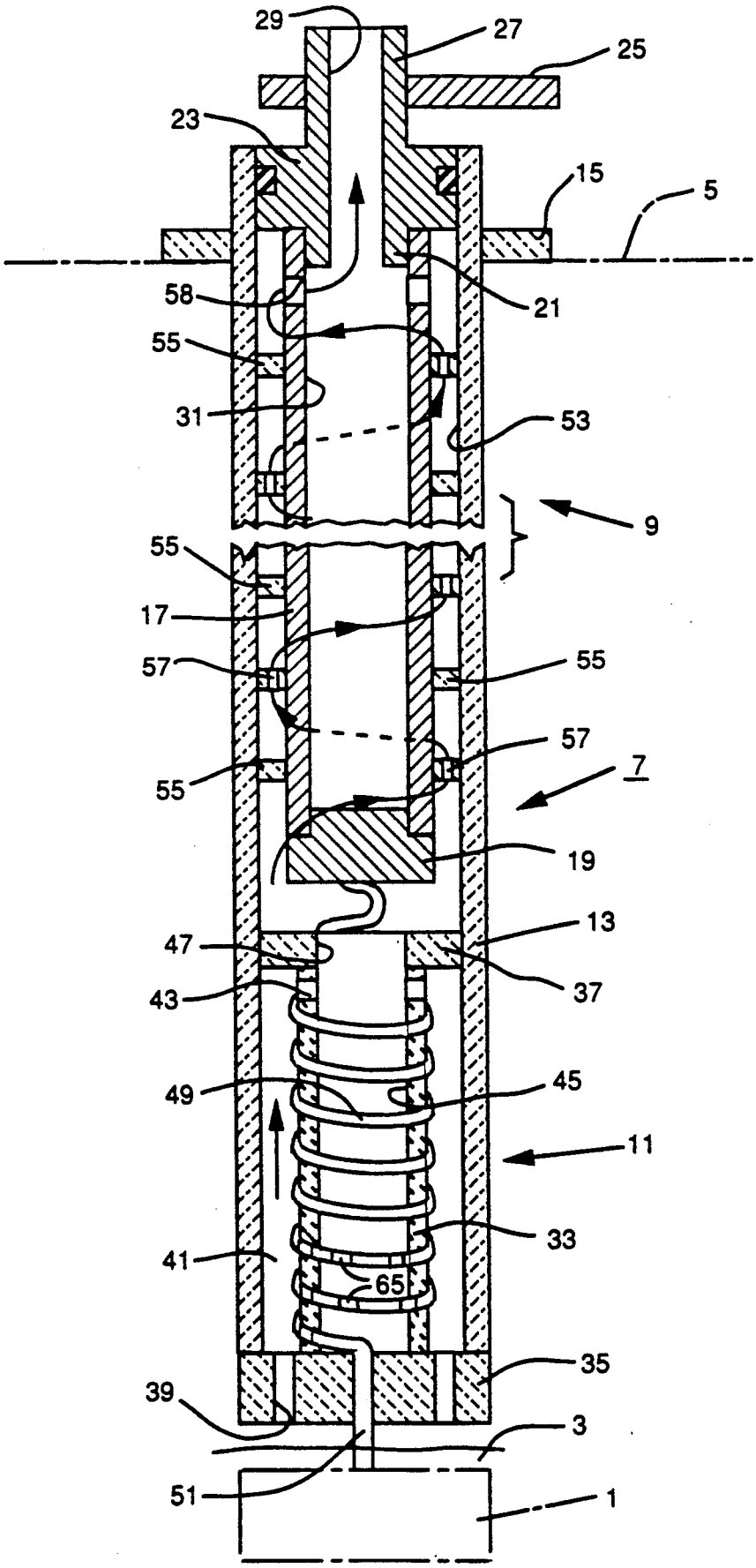
FIG. 1 is a vertical sectional view through a vapor cooled current lead using composite high temperature superconductors in accordance with the invention.

Turning to FIG. 1, a superconducting device 1 is immersed in a pool of liquid cryogen 3, such as helium, 3 inside a cryostat 5. The superconducting device 1 may be, for instance, an energy storage superconducting magnet, or a superconducting magnet for the proposed supercollider. Such devices have a requirement for a high input or output of current. This current is carried by the current lead 7 of the invention.

The current lead 7 has a normal conducting section 9 and a superconducting section 11, both housed within a thermal and electrically insulating tubular housing 13. The tubular housing 13 is mounted to the cryostat 5 by a mounting flange 15 with the housing extending from outside the cryostat 5 inward toward the superconducting device 1. A suitable material for the tubular housing 13 is a cryogenic grade glass epoxy laminate such as G10.

The normal conducting section 9 of the current lead 7 comprises a copper tube 17. The copper tube 17 extends from ambient conditions outside the cryostat inward through the tubular housing 13 to a copper heat sink member 19 at an intermediate point between the outside of the cryostat and the superconducting device 1. The upper end of the copper tube 17 seats on a collar 21 on an end plug 23 which is sealed in the end of the tubular housing 13. An upper terminal 25 is secured to an extension 27 on the end plug 23. An axial bore 29 through the end plug 23 communicates with the bore 31 in the copper tube 17.

The superconducting section 11 of the current lead 7 includes a tubular support 33 mounted inside the tubular housing 13 between a lower support plate 35 and upper support plate 37. Axial bores 39 through the lower support plate 35 connect an annular chamber 41 formed between the support tube 33 and the tubular housing 13 with the interior of the cryostat. Radial bores 43 through the upper end of the support tube 33 connect the upper end of the annular chamber 41 with the bore 45 in the support tube. A central bore 47 through the upper support plate 37 is aligned with the bore 45 in the support tube.

The superconducting section 11 of the current lead 7 also includes a composite high temperature superconductor 49 which is preferably wound in a helix in the annular chamber 41 around the support tube 33. The upper end of the composite superconductor 49 passes through the upper support plate 37 and is brazed to the heat sink member 19 of the normal conducting section 9. The lower end of the composite superconductor 49 passes through the lower support plate 35 and becomes the current lead lower terminal 51 which is connected to the superconducting device 1.

Cryogen vapor indicated by the arrows flows upward through the bores 39 into the annular chamber 41. As it flows upward through the chamber 41, it passes over and cools the composite superconductor 49. The vapor then passes inward through the radial bores 43 into the bore 45 and then through the bore 47. From the bore 47, the vapor passes around the heat sink member 19 and upward through an annular passage 53 between the copper tube 17 and the tubular housing 13. A series of flow baffle plates 55 with angularly displaced axial bores 57 direct the flow of the cryogen vapor in a spiral path around the copper tube 17. At the top of the annular passage 53, the cryogen vapor flows through radial bores 58 into the bore 31 in the copper tube, and then through the bore 31 and bore 29 in the end plug 23 to the atmosphere. The flow of cryogen vapor is sufficient to absorb the Joule heating of the resistive copper tubing 17 and conduction heating of the tube 17. The flow of cryogen vapor also maintains the composite high temperature superconductor 49 below its critical temperature.

The tubular housing 13, support tube 33, support plates 35 and 37 and the baffle plates 55 are all made of an electrically insulating material of low thermal conductivity. A suitable material is G10 which is widely used in cryogenic applications.

Figure 2:
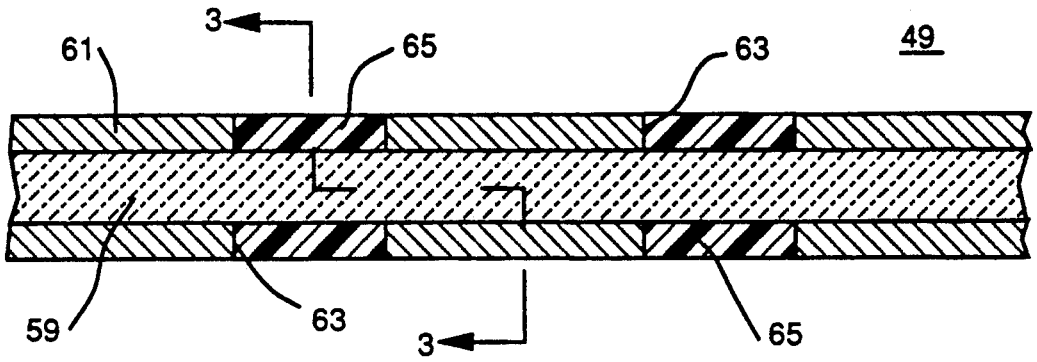
FIG. 2 is a longitudinal sectional view through a section of a composite high temperature superconductor which forms part of the vapor cooled current lead of FIG. 1.
Figure 3:
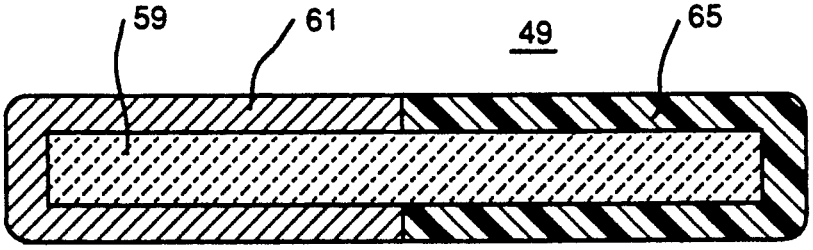
FIG. 3 is a cross sectional view through the composite high temperature superconductor shown in FIG. 2 and taken along the line 3—3.

As seen in FIGS. 2 and 3, the composite superconductor 49 of the superconducting section 11 has a core 59 of a ceramic high temperature superconducting material encased in and supported by a metal sheath 61. The ceramic high temperature superconducting core can be made for instance of bismuth based systems, yttrium based systems, and thallium based systems. Suitable bismth based systems include BiSrCaCuO compounds such as Bi-2212, and Bi(Pb)-2223. The thallium compounds include $TlSrCaCu_0$ such as Tl-2223. The metal sheath 61 can be, for instance, silver or gold. This sheath must be capable of establishing good electrical and thermal contact with the superconducting core 59. The sheath also should not have any deteriorating effect on the superconductor. Preparation of bismuth and thallium based high temperature composite superconductors with silver and gold sheaths, respectively, is described in "Processing of High-$T_c$ Superconductor Wires for Magnet Application", K. Heine et al., 1991 CEC, International Cryogenic Materials Conference, Huntsville, Ala., June 1991. Suitable yttrium compounds include a mixture of $YBa_2Cu_3O_{7-\delta}$ and $Y_2BaCuO_5$. Preparation of such material is described in Neal et al., "DC Transport Measurements at 77K of High $J_c$ Crystostabilized Melt Processed YBCO Monofilament", International Cryogenic Materials Conference, Huntsville, Ala., Jun. 10–14, 1991.

As described above, the composite high temperature superconductor 49 is not routed directly through the current lead 7, but instead, is routed in a non-linear path, and preferably is wound as a solenoid as shown in FIG. 1, to increase the total length of the composite superconductor 49. This is effective in minimizing the heat leak associated with the metallic sheath 61 in the composite high temperature superconductor 49 because in the superconducting state, the composite superconductor has no resistive dissipation (all of the current flows through the superconducting core and the silver sheath which is not superconducting remains resistive, but is short circuited by the superconducting core). Hence, the length of the superconducting core used in the composite superconductor has no effect on the electrical energy dissipation in the lead, i.e., the superconductor core can be made as long as desired.

However, heat conduction through the composite superconductor depends not only on the thermal conductivity but also the temperature gradient along the lead. The temperature gradient along the lead is reduced by winding the lead into the solenoid shown in FIG. 1 such that the length of the lead greatly exceeds the spacing between the two ends. For example, a factor of twenty increase in length reduces the temperature gradient, and consequently, the rate of heat reduction by the same factor.

Typical copper current lead operates at a current density of about 1000A/cm$^2$. Therefore, for an example of a 1000A current lead (assuming a RRR value of 100), the crosssectional area of a copper conductor will have a thermal resistance per unit length (1/Ak, where A is the crosssectional area and k is the thermal conductivity) of 0.158k/w·cm at 4.2K. YBCO/15% Ag ceramic superconductor bars operating at a current density of approximately 200Acm$^2$ (conditions similar to the 2-kA current lead discussed in the above referenced patent application) will have a thermal resistance per unit length of 6.66k/w·cm at 4.2K. Therefore, YBCO/15% Ag superconductor bars are 42 times more resistive to heat conduction. A composite silver sheath Bi-based ceramic superconductor with a 1:1 for superconductor to stabilizer sheath cross-sectional ratio and operating at 5000A/cm$^2$ current density in the superconducting core, will have a thermal resistance per unit length of 0.83K/w·cm at 4.2K. Thus, a reduction of temperature gradient by a factor of ten (i.e., a ten-time increase in conductor length through winding) will make the composite superconductor 52 times more resistive in thermal conduction than a straight copper conductor and 1.24 more resistive than the YBCO/15% Ag conductors.

In accordance with the invention, heat conduction through the composite conductor 49 is reduced effectively by stripping small sections of the metallic sheath 61 at spaced apart intervals to leave gaps 63 (see FIG. 2), along the composite conductor 49. The metal sheath may be chemically etched to form the gap 63, or mechanically removed such as by grinding. For instance, the silver may be etched away by using diluted nitric acid. However, a thin layer of silver should be retained to avoid acid attack on the ceramic high temperature superconducting core. The gaps 63 are filled with an adhesive 65 such as an epoxy which has a low thermal conductivity. This filler material maintains the mechanical integrity of the high temperature superconducting core.

Because of three orders of magnitude difference in thermal conductivity (about $5\times10^{-3}$ w/cm·k for Bi-based conductor material vs. ~5w/cm·k for silver at 4.2K), each millimeter of silver sheath removed is equivalent in thermal resistance to the addition of 1 m of silver sheath. Therefore, several of these millimeter long strippings of silver sheath will substantially reduce the heat leak. The epoxy filler has a thermal conductivity which is about one order of magnitude below that of the superconductor material ($\sim5\times10^{-4}$ w/cm·k), hence, it does not add to the heat leak.

Stripping of the metallic sheath and filling in the gaps with epoxy is most effective at the low temperature end of the composite superconductor 49 because the heat leak is proportional to the temperature gradient of the conductor near the liquid helium level. In addition, the metallic sheath is useful in bypassing current, should a portion of the high temperature superconductor core go normal. As this is more likely to occur at the high temperature end of the composite lead, this consideration also suggests forming the gaps in the metallic sheaths in the low temperature end. Accordingly, as seen in FIG. 2, several gaps 63, such as for example, about 5 to 20, but preferably 10 to 20, gaps filled with epoxy 65 are provided adjacent the low temperature end of the composite superconductor 49. These gaps filled with epoxy are typically spaced 3 to 8 (preferably about 5) mm apart along the composite lead 49.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A current lead for a superconducting device contained in a cryostat at a superconducting operating temperature, said power lead comprising:

a normal conducting section comprising normal conductor means extending from outside said cryostat at an ambient temperature inward to an intermediate point;

a superconducting section having composite superconductor means connected between said superconducting device at a low temperature end and said normal conductor means at a high temperature end, and comprising a core of a ceramic high temperature superconductor material which is superconducting below an intermediate temperature between said ambient temperature outside said cryostat and said operating temperature of the superconducting device, and a metallic sheath having a given thermal conductivity encasing and supporting said core of ceramic high temperature superconducting material, said metallic sheath being stripped away at spaced apart intervals to form gaps, and including filler means in said gaps comprising a filler material supporting said core and having a thermal conductivity at least an order of magnitude below said given thermal conductivity of said metallic sheath; and means maintaining said ceramic high temperature superconducting material below said intermediate temperature and cooling said normal conductor means to remove Joule heating from said normal conductor means and reduce thermal conduction through said normal conductor means and said composite high temperature superconducting lead.

2. The current lead of claim 1 wherein said gaps in said metallic sheath are adjacent said low temperature end.

3. The current lead of claim 2 wherein said metallic sheath is silver.

4. The current lead of claim 3 wherein said filler material is epoxy.

5. The current lead of claim 4 wherein said gaps are each approximately one millimeter in length.

6. The current lead of claim 5 wherein said composite superconductor means is routed in a non-linear path between said normal conductor means and said superconducting device to increase the length of said composite superconducting lead means.

7. The current lead of claim 6 wherein said cooling means comprises means directing a flow of a cryogen vapor over said composite superconductor means and said normal conductor means.

8. The current lead of claim 1 wherein said metallic sheath is silver.

9. The current lead of claim 8 wherein said filler material is epoxy.

10. The current lead of claim 9 wherein said ceramic high temperature superconducting material is a yttrium barium copper oxide compound.

11. The current lead of claim 9 wherein said ceramic high temperature superconducting material is a bismuth based compound.

12. The current lead of claim 1 wherein said means cooling said composite superconductor and said normal conductor means comprises means directing a flow of a cryogen vapor to cool said composite superconductor and said normal conductor means.

13. The current lead of claim 12 wherein said means directing a flow of a cryogen vapor includes a tubular housing in which said composite superconductor and said normal conductor means are mounted.

14. The current lead of claim 12 wherein said gaps in said metallic sheath are located adjacent said low temperature end of said superconductor.

15. The current lead of claim 14 wherein said metallic sheath is silver and said filler material is epoxy.

* * * * *